US009058010B2

(12) United States Patent
Ito et al.

(10) Patent No.: US 9,058,010 B2
(45) Date of Patent: Jun. 16, 2015

(54) IMAGE FORMING APPARATUS CONFIGURED TO PERFORM A PRIMARY TRANSFER OF A TONER IMAGE FROM A PLURALITY OF IMAGE BEARING MEMBERS TO AN INTERMEDIATE TRANSFER BELT BY FOLLOWING A CURRENT IN CIRCUMFERENTIAL DIRECTION WITH RESPECT TO THE INTERMEDIATE TRANSFER BELT

(75) Inventors: Yoshikuni Ito, Tokyo (JP); Yasuhiro Horiguchi, Tokyo (JP); Takayuki Tanaka, Yokohama (JP); Satoshi Tsuruya, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 18 days.

(21) Appl. No.: 13/877,444

(22) PCT Filed: Sep. 30, 2011

(86) PCT No.: PCT/JP2011/073161

§ 371 (c)(1),
(2), (4) Date: Apr. 2, 2013

(87) PCT Pub. No.: WO2012/046822

PCT Pub. Date: Apr. 12, 2012

(65) Prior Publication Data

US 2013/0188980 A1 Jul. 25, 2013

(30) Foreign Application Priority Data

Oct. 4, 2010 (JP) ..... 2010-225220
Sep. 28, 2011 (JP) ..... 2011-212310

(51) Int. Cl.
*G03G 15/16* (2006.01)
*G03G 15/00* (2006.01)

(52) U.S. Cl.
CPC ..... *G03G 15/80* (2013.01); *G03G 2215/0132* (2013.01); *G03G 2215/1661* (2013.01); *G03G 15/162* (2013.01)

(58) Field of Classification Search
CPC .. G03G 15/80; G03G 15/162; G03G 15/1675
USPC ..... 399/66, 302, 310, 314
See application file for complete search history.

(56) References Cited

U.S. PATENT DOCUMENTS 5,809,387 A * 9/1998 Takeuchi et al. ..... 399/302
5,930,556 A 7/1999 Imamiya (Continued)

FOREIGN PATENT DOCUMENTS

CN 1664717 A 9/2005
CN 1869837 A 11/2006

(Continued)

OTHER PUBLICATIONS

Machine translation of JP 10-268667 printed on Sep. 2, 2014.*

(Continued)

*Primary Examiner* — Sophia S Chen
(74) *Attorney, Agent, or Firm* — Canon U.S.A., Inc. IP Division

(57) ABSTRACT

An image forming apparatus sequentially transfers toner images formed on a plurality of photosensitive drums onto an intermediate transfer member or a transfer material to form an image. The image forming apparatus includes an intermediate transfer belt provided with electrical conductivity, and a power supply for applying a voltage to a current supply member contacting the outer circumferential surface of the intermediate transfer belt to pass a current from the current supply member to the plurality of photosensitive drums via the intermediate transfer belt, thus primarily transferring the toner images from the plurality of photosensitive drums onto the intermediate transfer belt.

11 Claims, 13 Drawing Sheets

(56) References Cited

U.S. PATENT DOCUMENTS

| | | | | |
|---|---|---|---|---|
| 6,226,486 | B1 | 5/2001 | Itou et al. | |
| 6,347,209 | B1 | 2/2002 | Bessho | |
| 6,442,356 | B2 | 8/2002 | Omata et al. | |
| 6,862,422 | B2 | 3/2005 | Aoki et al. | |
| 6,952,552 | B2 | 10/2005 | Aoki et al. | |
| 7,013,097 | B2 | 3/2006 | Akizuki et al. | |
| 7,139,498 | B2 | 11/2006 | Mashiba et al. | |
| 7,289,757 | B2 | 10/2007 | Sharma et al. | |
| 2001/0051056 | A1 | 12/2001 | Noguchi et al. | |
| 2005/0036807 | A1 | 2/2005 | Aoki | |
| 2005/0058473 | A1 | 3/2005 | Mizuno et al. | |
| 2006/0288896 | A1 | 12/2006 | Fukui et al. | |
| 2009/0028594 | A1 * | 1/2009 | Kojima | 399/66 |
| 2009/0136270 | A1 | 5/2009 | Yamada | |
| 2009/0148201 | A1 | 6/2009 | Sawai | |
| 2010/0232820 | A1 | 9/2010 | Usami et al. | |
| 2013/0188981 | A1 | 7/2013 | Horiguchi et al. | |
| 2013/0195519 | A1 | 8/2013 | Ito et al. | |

FOREIGN PATENT DOCUMENTS

| | | | |
|---|---|---|---|
| CN | 101504528 | A | 8/2009 |
| JP | 10-268667 | A | 10/1998 |
| JP | 2000-235315 | A | 8/2000 |
| JP | 2001-125338 | A | 5/2001 |
| JP | 2001-175092 | A | 6/2001 |
| JP | 2001183916 | A | 7/2001 |
| JP | 2003-035986 | A | 2/2003 |
| JP | 2004-102191 | A | 4/2004 |
| JP | 2005-250254 | A | 9/2005 |
| JP | 2006-047541 | A | 2/2006 |
| JP | 2006-259640 | A | 9/2006 |
| RU | 2373063 | C1 | 11/2009 |

OTHER PUBLICATIONS

Machine translation of JP 2001-175092 printed on Sep. 2, 2014.*
Machine translation of JP 2006-259640 printed on Sep. 2, 2014.*

* cited by examiner

IMAGE FORMING APPARATUS CONFIGURED TO PERFORM A PRIMARY TRANSFER OF A TONER IMAGE FROM A PLURALITY OF IMAGE BEARING MEMBERS TO AN INTERMEDIATE TRANSFER BELT BY FOLLOWING A CURRENT IN CIRCUMFERENTIAL DIRECTION WITH RESPECT TO THE INTERMEDIATE TRANSFER BELT

TECHNICAL FIELD

The present invention relates to an image forming apparatus such as a copying machine and a laser beam printer.

BACKGROUND ART

To achieve high-speed printing, an electrophotographic color image forming apparatus is known to include independent image forming units for respective colors, sequentially transfer images from the image forming units for respective colors onto an intermediate transfer belt, and collectively transfer images from the intermediate transfer belt onto a recording medium.

Each of the image forming units for respective colors includes a photosensitive drum as an image bearing member. Each image forming unit further includes a charging member for charging the photosensitive drum and a developing unit for developing a toner image on the photosensitive drum. The charging member of each image forming unit contacts the photosensitive drum with a predetermined pressure contact force to uniformly charge the surface of the photosensitive drum at a predetermined polarity and potential by using a charging voltage applied from a voltage power supply dedicated for charging (not illustrated).

The developing unit of each image forming unit applies toner to an electrostatic latent image formed on the photosensitive drum to develop a toner image (visible image).

In each image forming unit, a primary transfer roller (primary transfer member) facing the photosensitive drum via the intermediate transfer belt primarily transfers the developed toner image from the photosensitive drum onto the intermediate transfer belt. The primary transfer roller is connected to a voltage power supply dedicated for primary transfer.

A secondary transfer member secondarily transfers the primarily transferred toner image from the intermediate transfer belt onto a transfer material. A secondary transfer roller (secondary transfer member) is connected to a voltage power supply dedicated for secondary transfer.

Japanese Patent Application Laid-Open No. 2003-35986 discusses a configuration with which each of four primary transfer rollers is connected to each of four voltage power supplies dedicated for primary transfer. Japanese Patent Application Laid-Open No. 2001-125338 discusses control for changing, before image formation operation, a transfer voltage to be applied to each primary transfer roller depending on sheet-passing durability of an intermediate transfer belt and a primary transfer roller and on resistance variation due to environmental variation.

However, a conventionally known primary transfer voltage setting has the following problem. Since a suitable primary transfer voltage needs to be set in each image forming unit, a plurality of voltage power supplies is required. This increases the size of the image forming apparatus and the number of high-voltage power supplies, resulting in a cost increase. Since a suitable primary proper transfer voltage is calculated before image formation in consideration of resistance variation of the primary transfer member, it may take time until image formation is started.

SUMMARY OF INVENTION

The present invention is directed to an image forming apparatus providing suitable primary transfer performance while reducing the number of voltage power supplies for applying a voltage to primary transfer members.

According to an aspect of the present invention, an image forming apparatus includes: a plurality of image bearing members configured to bear toner images; a rotatable endless intermediate transfer belt configured to secondarily transfer onto a transfer material the toner images primarily transferred from the plurality of image bearing members; a current supply member configured to contact an outer surface of the intermediate transfer belt; and a power supply configured to apply a voltage to the current supply member, wherein the intermediate transfer belt is provided with electrical conductivity capable of passing a current from a contact position of the current supply member in the rotational direction of the intermediate transfer belt to the plurality of image bearing members via the intermediate transfer belt, and wherein the power supply applies a voltage to the current supply member to pass a current from the current supply member to the plurality of image bearing members via the intermediate transfer belt, to primarily transfer the toner images from the plurality of image bearing members onto the intermediate transfer belt.

According to exemplary embodiments of the present invention, supplying a current in the circumferential direction of an intermediate transfer belt from a current supply member contacting the outer surface of the intermediate transfer belt eliminates the need of preparing a plurality of voltage power supplies for primary transfer, enabling primary transfer to be performed with one current supply member. Thus, the cost and size of the image forming apparatus can be reduced.

Further features and aspects of the present invention will become apparent from the following detailed description of exemplary embodiments with reference to the attached drawings.

BRIEF DESCRIPTION OF DRAWINGS

The accompanying drawings, which are incorporated in and constitute a part of the specification, illustrate exemplary embodiments, features, and aspects of the invention and, together with the description, serve to explain the principles of the invention.

FIG. 1 is a sectional view schematically illustrating an image forming apparatus according to exemplary embodiments of the present invention.

[FIG. 2]

[FIG. 3]

FIG. 4 is a sectional view schematically illustrating an image forming apparatus having a transfer power supply for primary transfer in each image forming unit.

FIG. 5 is a sectional view schematically illustrating a method for measuring a potential of the intermediate transfer belt.

[FIG. 6]

[FIG. 7]

[FIG. 8]

FIG. 9 is a sectional view schematically illustrating a current flowing in the rotational direction of the intermediate transfer belt.

FIG. 10 is a timing chart illustrating timings of voltage application to members in an image forming unit.

[FIG. 11]

[FIG. 12]

DESCRIPTION OF EMBODIMENTS

Various exemplary embodiments, features, and aspects of the invention will be described in detail below with reference to the drawings.

Figure 1:
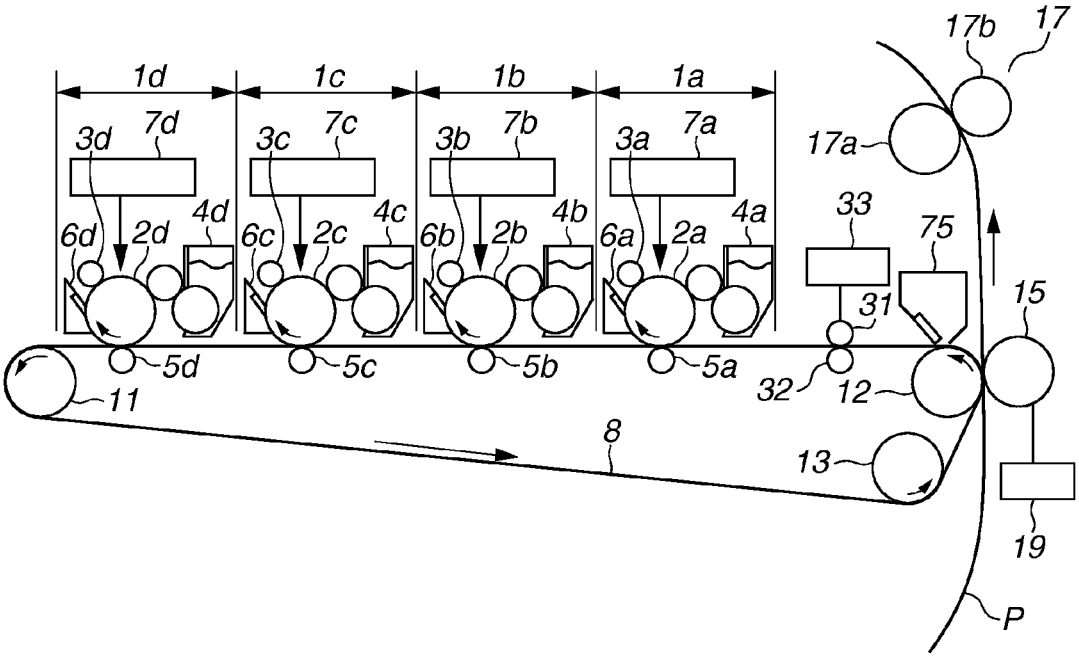
[FIG. 1]

FIG. 1 illustrates a configuration of an in-line type color image forming apparatus (having four drums) according to exemplary embodiments of the present invention. The image forming apparatus includes four image forming units: an image forming unit 1*a* for forming a yellow image, an image forming unit 1*b* for forming a magenta image, an image forming unit 1*c* for forming a cyan image, and an image forming unit 1*d* for forming a black image. These four image forming units are arranged on a line at fixed intervals.

The image forming units 1*a*, 1*b*, 1*c*, and 1*d* include photosensitive drums 2*a*, 2*b*, 2*c*, and 2*d* (image bearing members), respectively. In the present exemplary embodiment, each of the photosensitive drums 2*a*, 2*b*, 2*c*, and 2*d* is composed of a drum base (not illustrated) such as aluminum and a photosensitive layer (not illustrated), a negatively charged organic photosensitive member, on the drum base. The photosensitive drums 2*a*, 2*b*, 2*c*, and 2*d* are rotatably driven by a drive unit (not illustrated) at predetermined process speed.

Charging rollers 3*a*, 3*b*, 3*c*, and 3*d* and developing units 4*a*, 4*b*, 4*c*, and 4*d* are arranged around the photosensitive drums 2*a*, 2*b*, 2*c*, and 2*d*, respectively. Drum cleaning units 6*a*, 6*b*, 6*c*, and 6*d* are arranged around the photosensitive drums 2*a* 2*b*, 2*c*, and 2*d*, respectively. Exposure units 7*a*, 7*b*, 7*c*, and 7*d* are arranged above the photosensitive drums 2*a* 2*b*, 2*c*, and 2*d*, respectively. Yellow toner, cyan toner, magenta toner, and black toner are stored in the developing units 4*a*, 4*b*, 4*c*, and 4*d*, respectively. The regular toner charging polarity according to the present exemplary embodiment is the negative polarity.

An intermediate transfer belt 8 (a rotatable endless intermediate transfer member) is arranged facing the four image forming units. The intermediate transfer belt 8 is supported by a drive roller 11, a secondary transfer counter roller 12, and a tension roller 13 (these three rollers are collectively referred to as supporting rollers or supporting members), and rotated (moved) in a direction indicated by the arrow (counterclockwise direction) by the driving force of the drive roller 11 driven by a motor (not illustrated). Hereinafter, the rotational direction of the intermediate transfer belt 8 is referred to as a circumferential direction of the intermediate transfer belt 8. The drive roller 11 is provided with a surface layer made of high-friction rubber to drive the intermediate transfer belt 8. The rubber layer provides electrical conductivity with a volume resistivity of $10^5$ Ω-cm or below. The secondary transfer counter roller 12 and a secondary transfer roller 15 form a secondary transfer section via the intermediate transfer belt 8. The secondary transfer counter roller 12 is provided with a surface layer made of rubber to provide electrical conductivity with a volume resistivity of $10^5$ Ω-cm or below. The tension roller 13 is made of a metal roller which gives tension with a total pressure of about 60 N to the intermediate transfer belt 8 to be driven and rotated by the rotation of the intermediate transfer belt 8.

The drive roller 11, the secondary transfer counter roller 12, and the tension roller 13 are grounded via a resistor having a predetermined resistance value. The present exemplary embodiment uses resistors having three different resistance values of 1 GΩ, 100 MΩ, and 10 MΩ. Since the resistance value of the rubber layers of the driver roller 11 and the secondary transfer counter roller 12 is sufficiently smaller than 1 GΩ, 100 MΩ, and 10 MΩ, electrical effects of these rollers can be ignored.

The secondary transfer roller 15 is an elastic roller having a volume resistivity of $10^7$ to $10^9$ Ω-cm and a rubber hardness of 30 degrees (Asker C hardness meter). The secondary transfer roller 15 is pressed onto the secondary transfer counter roller 12 via the intermediate transfer belt 8 with a total pressure of about 39.2 N. The secondary transfer roller 15 is driven and rotated by the rotation of the intermediate transfer belt 8. A voltage of −2.0 to 7.0 kV from a transfer power supply 19 can be applied to the secondary transfer roller 15.

A belt cleaning unit 75 for removing and collecting residual transfer toner remaining on the surface of the intermediate transfer belt 8 is arranged on the outer surface of the intermediate transfer belt 8. In the rotational direction of the intermediate transfer belt 8, a fixing unit 17 including a fixing roller 17*a* and a pressure roller 17*b* is arranged on the downstream side of the secondary transfer section at which the secondary transfer counter roller 12 contacts the secondary transfer roller 15.

An image formation operation will be described below.

When a controller issues a start signal for starting the image formation operation, transfer materials (recording mediums) are sent out one by one from a cassette (not illustrated) and then conveyed to a registration roller (not illustrated). At this timing, the registration roller (not illustrated) is stopped and the leading edge of the transfer material stands by at a position immediately before the secondary transfer section. When the start signal is issued, on the other hand, the photosensitive drums 2*a*, 2*b*, 2*c*, and 2*d* in the image forming units 1*a*, 1*b*, 1*c*, and 1*d*, respectively, start rotating at predetermined process speed. In the present exemplary embodiment, the photosensitive drums 2*a*, 2*b*, 2*c*, and 2*d* are uniformly charged to the negative polarity by the charging rollers 3*a*, 3*b*, 3*c*, and 3*d*, respectively. Then, exposure units 7*a*, 7*b*, 7*c*, and 7*d* irradiate the photosensitive drums 2*a*, 2*b*, 2*c* and 2*d*, respectively, with laser beams to perform scanning exposure to form electrostatic latent images thereon.

The developing unit 4*a*, to which a developing voltage having the same polarity as the charging polarity (negative polarity) of the photosensitive drum 2*a* is applied, applies yellow toner to the electrostatic latent image formed on the photosensitive drum 2*a* to visualize it as a toner image. The charge amount and the exposure amount are adjusted so that each photosensitive drum has a −500 V potential after being charged by the charging roller and a −100 V potential (image portion) after being exposed by the exposure unit. A developing bias voltage is −300 V. The process speed is 250 mm/sec. An image formation width which is a length in a direction perpendicular to the conveyance direction (rotational direction) is set to 215 mm. The toner charge amount is set to −40 μC/g. The toner amount on each photosensitive drum for solid image is set to 0.4 mg/cm2.

This yellow toner image is primarily transferred onto the rotating intermediate transfer belt 8. A portion facing each photosensitive drum, at which a toner image is transferred from each photosensitive drum onto the intermediate transfer belt 8, is referred to as a primary transfer section. A plurality of primary transfer sections corresponding to the plurality of image bearing members is provided on the intermediate transfer belt 8. The present exemplary embodiment performs primary transfer by using the current flowing in the rotational direction of the intermediate transfer belt 8 from the current supply member contacting the outer surface of the intermediate transfer belt 8. (The current supply member will be described in detail below.)

As illustrated in FIG. 1, the current supply member is arranged on the downstream side of the belt cleaning unit 75 in the rotational direction of the intermediate transfer belt 8 and on the upstream side of the image forming unit 1*a* in the rotational direction of the intermediate transfer belt 8. A transfer power supply 33 for primary transfer is connected to a primary transfer power feeding roller 31 (current supply member for primary transfer). A primary transfer power feeding counter roller 32 is arranged facing the primary transfer power feeding roller 31 via the intermediate transfer belt 8.

Referring to FIG. 1, counter members 5*a*, 5*b*, 5*c*, and 5*d* are arranged facing the image forming units 1*a*, 1*b*, 1*c*, and 1*d*, respectively, via the intermediate transfer belt 8. The counter members 5*a*, 5*b*, 5*c*, and 5*d* press respective facing photosensitive drums 2*a*, 2*b*, 2*c*, and 2*d* via the intermediate transfer belt 8 to form nip portions that can be kept wide and stable in this way. In the present exemplary embodiment, the counter members 5*a*, 5*b*, 5*c*, and 5*d* are electrically insulated, i.e., they do not serve as voltage-applied members connected to the voltage power supplies for primary transfer. Since voltage-applied members as illustrated in FIG. 4 have electrical conductivity so that a desired current flows therein, resistance value adjustment is made for the voltage-applied members causing a cost increase.

A region on the intermediate transfer belt 8 where the yellow toner image has been transferred thereon is moved to the image forming unit 1*b* by the rotation of the intermediate transfer belt 8. Then, in the image forming unit 1*b*, a magenta toner image formed on the photosensitive drum 2*b* is similarly transferred onto the intermediate transfer belt 8 so that the magenta toner image is superimposed onto the yellow toner image. Likewise, in the image forming units 1*c* and 1*d*, a cyan toner image formed on the photosensitive drum 2*c* and then a black toner image formed on the photosensitive drum 2*d* are respectively transferred onto the intermediate transfer belt 8 so that the cyan toner image is superimposed onto the two-color (yellow and magenta) toner image and then the black toner image is superimposed onto the three-color (yellow, magenta, and cyan) toner image, thus forming a full color toner image on the intermediate transfer belt 8.

Then, in synchronization with a timing when the leading edge of the full color toner image on the intermediate transfer belt 8 is moved to the secondary transfer section, a transfer material P is conveyed to the secondary transfer section by a registration roller (not illustrated). The full color toner image on the intermediate transfer belt 8 is secondarily transferred at one time onto the transfer material P by the secondary transfer roller 15 to which the secondary transfer voltage (a voltage having an opposite polarity of toner polarity (positive polarity)) is applied. The transfer material P having the full color toner image formed thereon is conveyed to the fixing unit 17. A fixing nip portion composed of a fixing roller 17*a* and a pressure roller 17*b* applies heat and pressure to the full color toner image to fix it onto the surface of the transfer material P and then discharges it to the outside.

Figure 4:
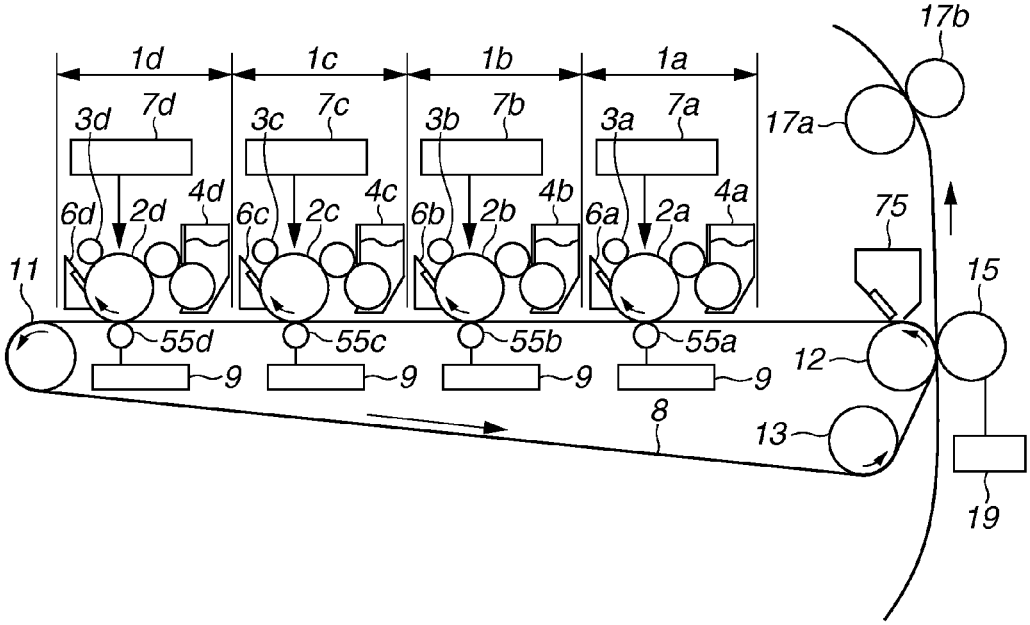
[FIG. 4]

The present exemplary embodiment is characterized in that primary transfer for transferring toner images from the photosensitive drums 2*a*, 2*b*, 2*c*, and 2*d* onto the intermediate transfer belt 8 is performed without applying a voltage to primary transfer rollers 55*a*, 55*b*, 55*c*, and 55*d*, as illustrated in FIG. 4.

To describe the features of the present exemplary embodiment, the volume resistivity, the surface resistivity, and the circumferential resistance value of the intermediate transfer belt 8 will be described below. A definition of the circumferential resistance value and a method for measuring the circumferential resistance value will be described below.

The volume and surface resistivity of the intermediate transfer belt 8 used in the present exemplary embodiment will be described below.

In the present exemplary embodiment, the intermediate transfer belt 8 has a base layer made of a 100-μm thick polyphenylene sulfide (PPS) resin containing distributed carbon for electrical resistance value adjustment. The resin used may be polyimide (PI), polyvinylidene fluoride (PVdF), nylon, polyethylene terephthelate (PET), polybutylene terephthelate (PBT), polycarbonate, polyether ether ketone (PEEK), polyethylene naphthalate (PEN), and on.

The intermediate transfer belt 8 has a multilayer configuration. Specifically, the base layer is provided with an outer surface layer made of a 0.5- to 3-μm thick high-resistance acrylic resin. The high-resistance surface layer is used to obtain an effect of improving the secondary transfer performance of small-sized paper by reducing a current difference between a sheet-passing region and a non-sheet-passing region in the longitudinal direction of the secondary transfer section.

A method for manufacturing a belt will be described below. The present exemplary embodiment employs a method for manufacturing a belt based on the inflation fabricating method. PPS (basis material) and a blending component such as carbon black (conductive material powder) are melted and mixed by using a two-axis sand mixer. The obtained mixed object is extrusion-molded by using an annular dice to form an endless belt.

An ultraviolet ray hardening resin is spray-coated onto the surface of the molded endless belt and, after the resin dries, ultraviolet ray is radiated onto the belt surface to harden the resin, thus forming a surface coating layer. Since too thick a coating layer is easy to crack, the amount of coated resin is adjusted so that the coating layer becomes 0.5- to 3-μm thick.

The present exemplary embodiment uses carbon black as electrical conductive material powder. An additive agent for adjusting the resistance value of the intermediate transfer belt 8 is not limited. Exemplary conductive fillers for resistance value adjustment include carbon black and many other conductive metal oxides. Agents for non-filler resistance value adjustment include various metal salts, ion conductive materials with low-molecular weight such as glycol, antistatic resins containing ether bond, hydroxyl group, etc., in molecules, and organic polymer high-molecular compounds.

Although increasing the amount of additive carbon lowers the resistance value of the intermediate transfer belt 8, too much amount of additive carbon decreases the strength of the belt making it easy to crack. In the present exemplary embodiment, the resistance of the intermediate transfer belt 8 is lowered within an allowable range of belt strength usable for the image forming apparatus.

In the present exemplary embodiment, the Young's modulus of the intermediate transfer belt 8 is about 3000 MPas. The Young's modulus E was measured conforming to JIS-K7127, "Plastics—Determination of tensile properties" by using a material under test having a thickness of 100 μm.

Table 1 illustrates the amount of additive carbon (in relative ratio) for various bases.

TABLE 1

| | Amount of additive carbon (in relative ratio) | Coating layer |
|---|---|---|
| Comparative sample belt | 0.5 | Not provided |
| Belt A | 1 | Provided |
| Belt B | 1.5 | Provided |
| Belt C | 2 | Provided |
| Belt D | 1.5 | Not provided |
| Belt E | 2 | Not provided |

Table 1 also illustrates the presence or absence of a surface coating layer. For example, the amount of additive carbon for the belt B is 1.5 times that for the belt A, and the amount of additive carbon for the belt C is twice that for the belt A. The belts A, B, and C are provided with a surface layer, and the belts D and E are not provided therewith (a single-layer belt). The amount of additive carbon for the belt B is the same as that for the belt D, and the amount of additive carbon for the belt C is the same as that for the belt E.

A comparative sample belt made of polyimide was made with the amount of additive carbon (in relative ratio) changed for resistance value adjustment. The comparative sample belt has an amount of additive carbon (in relative ratio) of 0.5 and volume resistivity of $10^{10}$ to $10^{11}$ Ω-cm. As an intermediate transfer belt, this comparative sample belt has an ordinary resistance value.

Results of volume and surface resistivity measurement for the comparative sample belt and the belts A to E will be described below.

The volume and surface resistivity of the comparative sample belt and the belts A to E were measured by using the Hiresta UP (MCP-HT450) resistivity meter from MITSUBISHI CHEMICAL ANALYTECH. Table 2 illustrates measured values of the volume and surface resistivity (outer surface of each belt). The volume and surface resistivity were measured conforming to JIS-K6911, "Testing method for thermosetting plastics" by using a conductive rubber electrode after obtaining preferable contact between the electrode and the surface of each belt. Measurement conditions include application time of 30 seconds and applied voltages of 10 V and 100 V.

TABLE 2

| | Volume resistivity (Ω-cm) | | Surface resistivity (Ω/sq.) | |
|---|---|---|---|---|
| Applied voltage | 10 V | 100 V | 10 V | 100 V |
| Comparative sample belt | over | $1.0 \times 10^{10}$ | over | $1.0 \times 10^{10}$ |
| Belt A | over | $2.0 \times 10^{12}$ | over | $1.0 \times 10^{12}$ |
| Belt B | $1.0 \times 10^{12}$ | under | $4.0 \times 10^{11}$ | $2.0 \times 10^{8}$ |
| Belt C | $1.0 \times 10^{10}$ | under | $5.0 \times 10^{10}$ | under |
| Belt D | $5.0 \times 10^{6}$ | under | $5.0 \times 10^{6}$ | under |
| Belt E | under | under | under | under |

When the applied voltage is 100 V, the comparative sample belt exhibits volume resistivity of $1.0\times10^{10}$ Ω-cm and surface resistivity of $1.0\times10^{10}$ Ω/sq. When the applied voltage is 10 V, however, the comparative sample belt has too small a current flow and hence is unable to be subjected to volume resistivity measurement. In this case, the resistivity meter displays "over."

When the applied voltage is 100 V, the belts B, C, and D have too large a current flow because of the low resistance and hence are unable to be subjected to volume resistivity measurement. In this case, the resistivity meter displays "under." When the applied voltage is 100 V, the belt B exhibits surface resistivity of $2.0\times10^{8}$ Ω/sq., but the belts C and D are unable to be subjected to surface resistivity measurement ("under").

Referring to Table 2, when the applied voltage is 10 V, the belt A is unable to be subjected to volume and surface resistivity measurement. When the applied voltage is 100 V, the belt A exhibits higher surface resistivity than the comparative sample belt. This phenomenon is caused by the effect of the coating layer, i.e., the belt A having a high-resistance surface coating layer has a higher resistance than the comparative sample belt not having a surface coating layer.

The comparison between the belts B and D and the comparison between the belts C and E indicate that the coating layer provides a high resistance value. The comparison between the belts B and C and the comparison between the belts D and E indicate that increasing the amount of additive carbon decreases the resistance value. The belt E provides too low a resistance value and hence is unable to be subjected to measurement of all items.

In the present exemplary embodiment, it is necessary to use the intermediate transfer belt 8 having such volume and surface resistivity that give "under" display in Table 2. Therefore, a resistance value other than the volume and surface resistivity defined for the intermediate transfer belt 8 was measured. Another resistance value defined for the intermediate transfer belt 8 is the above-mentioned circumferential resistance.

A method for obtaining the circumferential resistance of the intermediate transfer belt 8 will be described below.

Figure 2A:
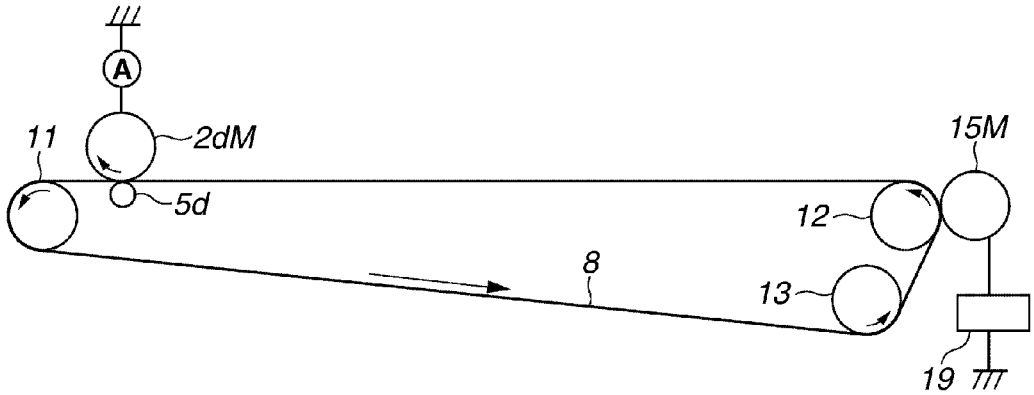
FIGS. 2A and 2B are sectional views schematically illustrating a method for measuring a circumferential resistance of an intermediate transfer belt according to exemplary embodiments of the present invention.
Figure 2B:
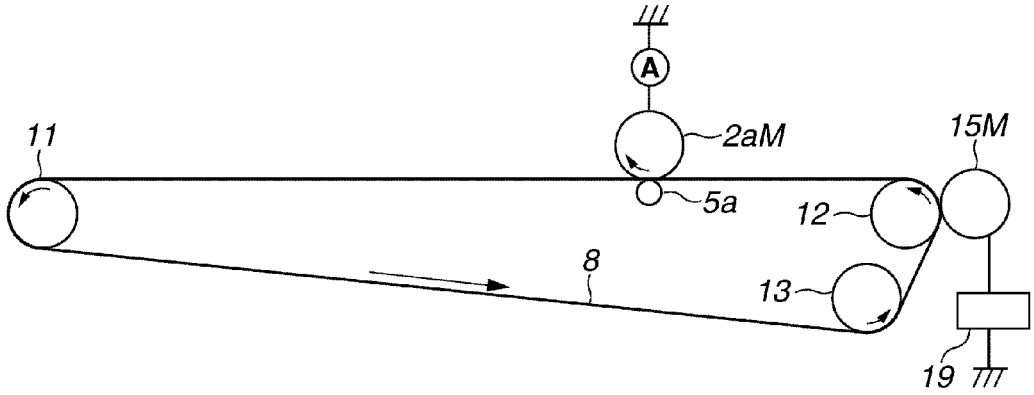

In the present exemplary embodiment, the circumferential resistance of the intermediate transfer belt 8 having a lowered resistance was measured with a method illustrated in FIGS. 2A and 2B. Referring to FIG. 2A, when a fixed voltage (measurement voltage) is applied from a high-voltage power supply (the transfer power supply 19) to an outer surface roller 15M (first metal roller), the method detects a current flowing in an ammeter (current detection unit) connected to a photosensitive drum 2*d*M (second metal roller) of the image forming unit 1*d*. Based on the detected current value, the method obtains a resistance value of the intermediate transfer belt 8 between contact portions of the photosensitive drum 2*d*M and the outer surface roller 15M. Specifically, the method measures a current flowing in the circumferential direction (rotational direction) of the intermediate transfer belt 8 and then divides the measurement voltage value by the measured current value to obtain the resistance value of the intermediate transfer belt 8. To eliminate the effect of resistances other than the resistance of the intermediate transfer belt 8, the outer surface roller 15M and the photosensitive drum 2*d*M made only of metal (aluminum) are used. For this reason, the reference numerals of the roller and belt are followed by letter M (Metal). In the present exemplary embodiment, the distance between the contact portion of the outer surface roller 15M and the photosensitive drum 2*d*M. is 370 mm (on the upper surface side of the intermediate transfer belt 8) and 420 mm (on the lower surface side thereof).

Figure 3A:
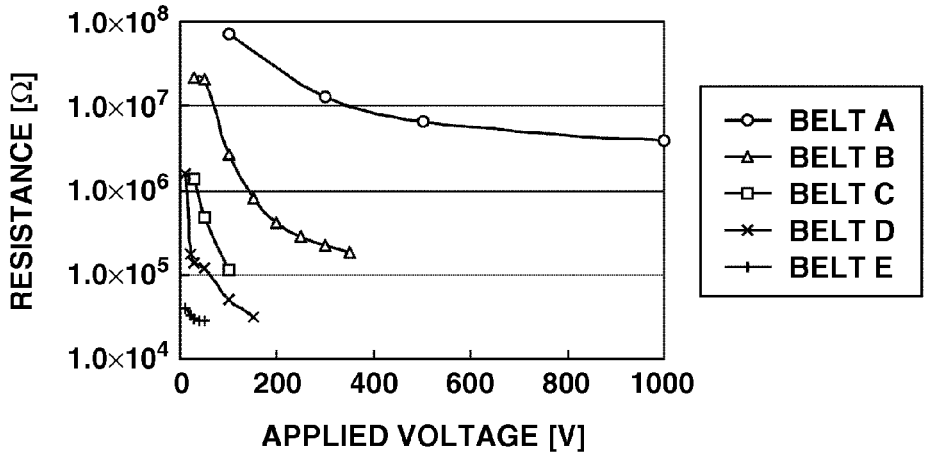
FIGS. 3A and 3B are graphs illustrating circumferential resistance measurement results for the intermediate transfer belt.

FIG. 3A illustrates a resistance measurement result for the belts A to E with varying applied voltage based on the above-mentioned measurement method. With this measurement method, the resistance in the circumferential direction (rotational direction) of the intermediate transfer belt 8 was measured. In the present exemplary embodiment, therefore, the resistance of the intermediate transfer belt 8 measured with this measurement method is referred to as circumferential resistance (in Ω).

All of the belts A to E have a tendency that the resistance gradually decreases with increasing applied voltage. This tendency is seen with belts with which a resin contains distributed carbon.

The method in FIG. 2B differs from the method in FIG. 2A only in the ammeter position. In this case, the resistance measurement result almost coincides with that in FIG. 3B, which means that the measurement method according to the present exemplary embodiment is irrelevant to the ammeter position.

With the method illustrated in FIGS. 2A and 2B, resistance measurement is accomplished with the belts A to E but not with the comparative sample belt. This is because the comparative sample belt is a belt used for an image forming apparatus in which the primary transfer rollers 55*a*, 55*b*, 55*c*, and 55*d* are connected with respective voltage power supplies as illustrated in FIG. 4

The image forming apparatus having the configuration in FIG. 4 is designed to provide high volume and surface resistivity of the intermediate transfer belt 8 so that adjacent voltage power supplies are not mutually affected (interfered) by a current flowing therein via the intermediate transfer belt 8. The comparative sample belt has a resistance to such an extent that the primary transfer sections do not interfere with each other even when a voltage is applied to the primary transfer rollers 55*a*, 55*b*, 55*c*, and 55*d*. The comparative sample belt is designed not to easily produce a current flow in the circumferential direction. A belt like the comparative sample belt is defined as a high-resistance belt, and a belt having a current flow in the circumferential direction like the belts A to E is defined as a conductive belt.

Figure 3B:
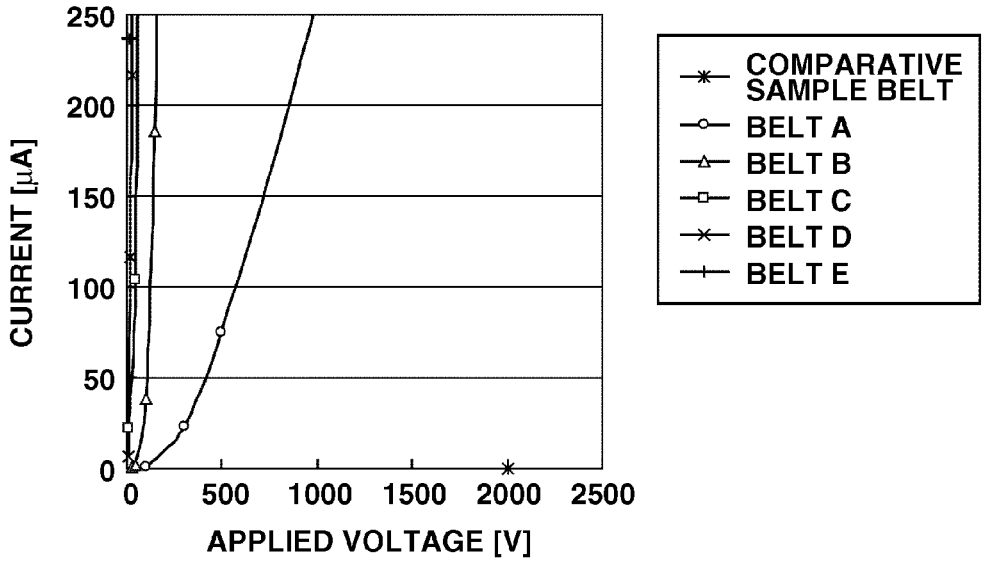

FIG. 3B is a graph formed by plotting current values measured by the measurement method used for FIG. 2A. Referring to FIG. 3A, the resistance value (in Ω) assigned to the vertical axis is obtained by dividing the current value measured in FIG. 3B by the applied voltage.

Referring to FIG. 3B, with the comparative sample belt, no current flowed in the circumferential direction even when the applied voltage was 2000 V. With the belts A to E, however, a current of 50 μA or above flowed even when the applied voltage was 500 V or below. The present exemplary embodiment uses the intermediate transfer belt 8 having a circumferential resistance of $10^4$ to $10^8$Ω. With a circumferential resistance lower than $10^4$Ω, the volume resistivity falls and hence the desired secondary transfer performance cannot be ensured. With a circumferential resistance higher than $10^8$Ω, a current does not easily flow in the circumferential direction and hence the desired primary transfer performance cannot be ensured.

Figure 5:
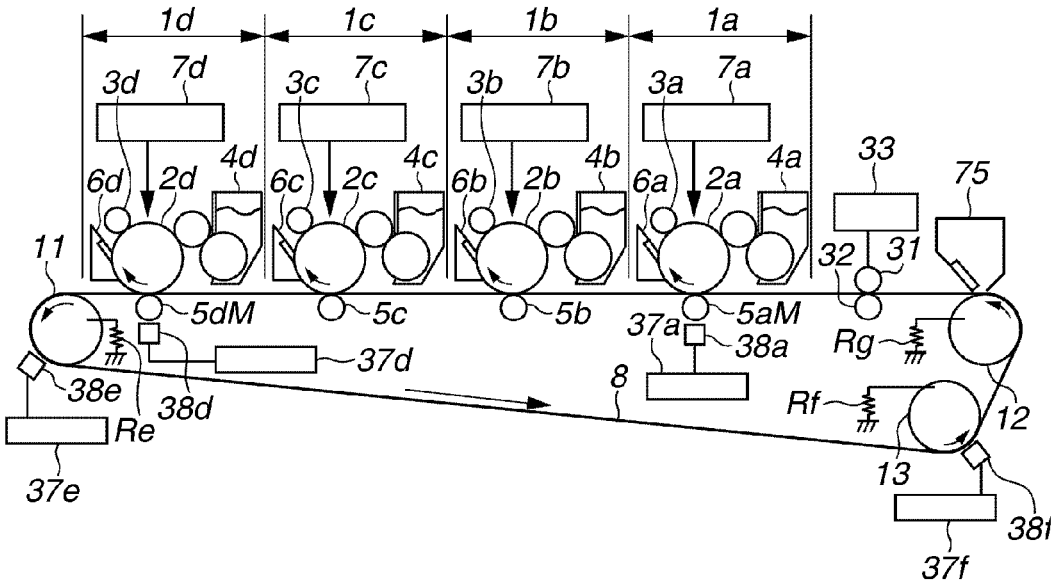
[FIG. 5]

A surface potential of the intermediate transfer belt 8 having a circumferential resistance of $10^4$ to $10^8$Ω will be described below. FIGS. 5A and 5B illustrate a method for measuring the surface potential of the intermediate transfer belt 8. Referring to FIGS. 5A and 5B, potential measurement is made at four different portions by using four surface potential meters. Metal rollers 5*d*M and 5*a*M are used for measurement.

A surface potential meter 37*a* and a measurement probe 38*a* are used to measure the potential of the primary transfer roller 5*a*M (metal roller) of the image forming unit 1*a*. The MODEL 344 surface potential meters from TREK JAPAN were used. Since the metal rollers 5*d*M and 5*a*M have the same potential as the inner surface of the intermediate transfer belt 8, this method can be used to measure the inner surface potential of the intermediate transfer belt 8. Similarly, a surface potential meter 37*d* and a measurement probe 38*d* are used to measure the inner surface potential of the intermediate transfer belt 8 based on the potential of the primary transfer roller 5*d*M (metal roller) of the image forming unit 1*d*.

A surface potential meter 37*e* and a measurement probe 38*e* are arranged facing a drive roller 11 to measure the outer surface potential of the intermediate transfer belt 8. A surface potential meter 37*f* and a measurement probe 38*f* are arranged facing the tension roller 13 to measure the outer surface potential of the intermediate transfer belt 8. Resistors Re, Rf, and Rg are connected to the drive roller 11, the secondary transfer counter roller 12, and the tension roller 13, respectively.

When the potential of the intermediate transfer belt 8 was measured with this measurement method, there was almost no potential difference between measurement portions, and the intermediate transfer belt 8 exhibited almost the same potential therein. Specifically, although the intermediate transfer belt 8 used in the present exemplary embodiment has a resistance value to some extent, it can be considered as a conductive belt.

Figure 6A:
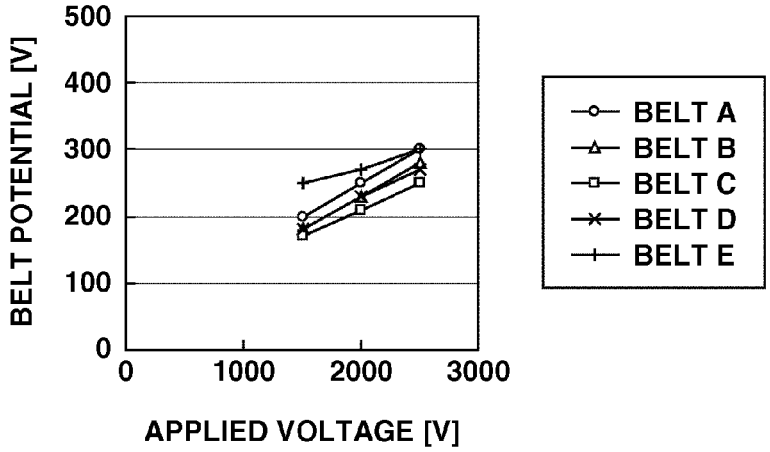
FIGS. 6A to 6C are graphs illustrating surface potential measurement results for the intermediate transfer belt.
Figure 6B:
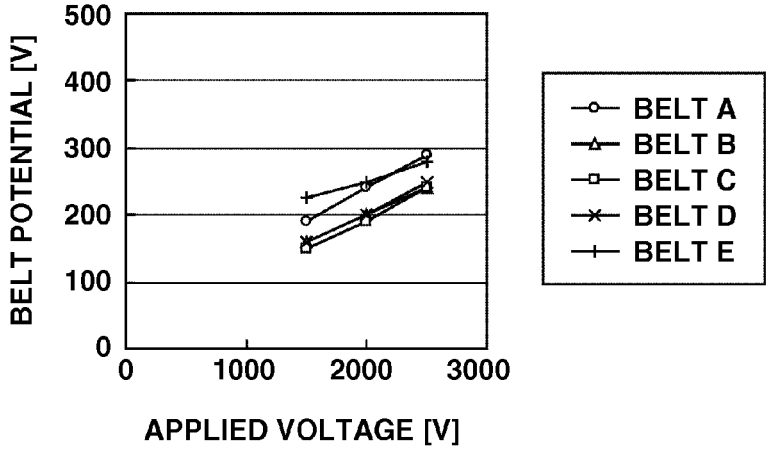
Figure 6C:
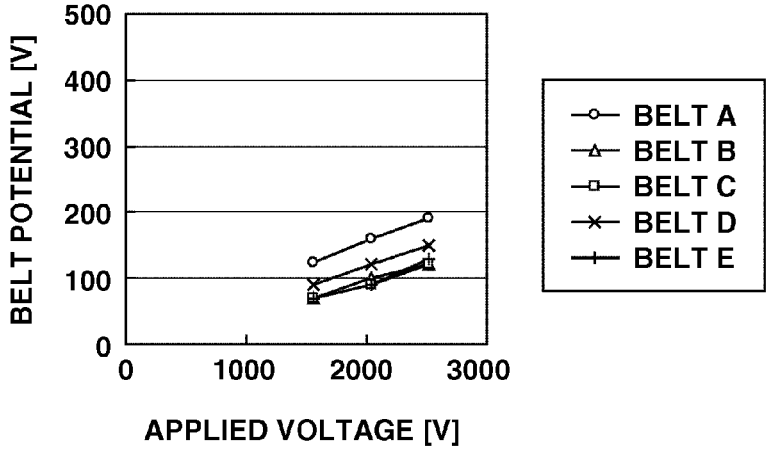

FIGS. 6A to 6C illustrate surface potential measurement results for the intermediate transfer belt 8. FIG. 6A illustrates a result when the resistors Re, Rf, and Rg have a resistance of 1 GΩ. The vertical axis is assigned a voltage applied to the transfer power supply 33 and the horizontal axis is assigned the potential of the intermediate transfer belt 8. FIG. 6A illustrates a measurement result for the belts A to E.

Similarly, FIG. 6B illustrates a result when the resistors Re, Rf, and Rg have a resistance of 100 MΩ. FIG. 6C illustrate a result when the resistors Re, Rf, and Rg have a resistance of 10 MΩ.

With any belt, the surface potential increases with increasing applied voltage, and decreases with decreasing resistance values of the resistors Re, Rf, and Rg (1 GΩ, 100 MΩ, and 10 MΩ in this order). Although all of the resistors Re, Rf, and Rg have the same resistance, it is known that decreasing the resistance of any one resistor decreases the surface potential of each belt accordingly.

With an intermediate transfer belt having a resistance with which a current does not flow in the circumferential direction like the comparative sample belt, the surface potential of each belt cannot be measured with the above method. Potential measurement probes cannot be arranged with a configuration with which a voltage is applied from a dedicated power supply 9 to the primary transfer rollers 55*a*, 55*b*, 55*c*, and 55*d* as illustrated in FIG. 4. Even if potential measurement probes are arranged facing supporting rollers 11, 12, and 13, the surface potential of the intermediate transfer belt 8 at the primary transfer sections cannot be measured since the potential differs at different positions in the circumferential direction.

A reason why toner images can be transferred from the photosensitive drums 2*a*, 2*b*, 2*c*, and 2*d* to the intermediate transfer belt 8 with the configuration according to the present exemplary embodiment will be described below with reference to FIGS. 7A to 7D.

Figure 7A:
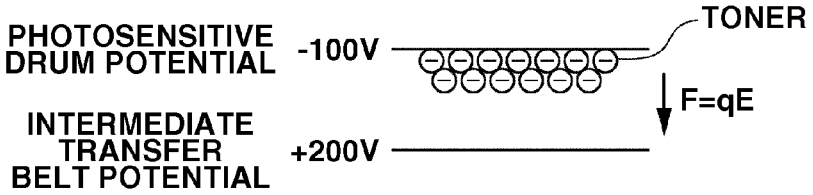
FIGS. 7A to 7D illustrate primary transfer according to exemplary embodiments of the present invention.

FIG. 7A illustrates a potential relation at each primary transfer section. The potential of each photosensitive drum is −100 V at the toner portion (image portion), and the surface potential of the intermediate transfer belt 8 is +200 V. Toner having a charge amount q developed on the photosensitive drum is subjected to a force F in the direction of the intermediate transfer belt 8 and then primarily transferred by an electric field E formed by the potential of the photosensitive drum and the potential of the intermediate transfer belt 8.

Figure 7B:
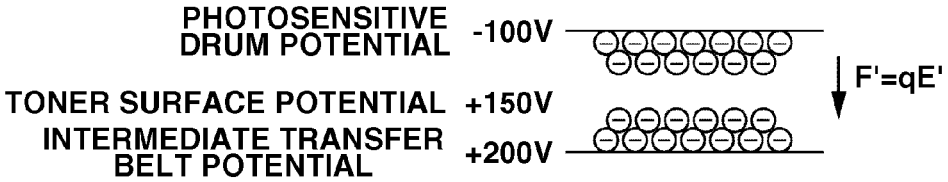

FIG. 7B illustrates multiplexed transfer which refers to processing for primarily transferring toner onto the intermediate transfer belt 8 and then further primarily transferring toner of other color onto the former toner. FIG. 7B illustrates a state where toner is negatively charged and the toner surface potential is +150 V by the transferred toner. In this case, toner on each photosensitive drum is subjected to a force F' in the direction of the intermediate transfer belt 8 and then primarily transferred by an electric field E' formed by the potential of the photosensitive drum and the surface potential of toner.

Figure 7C:
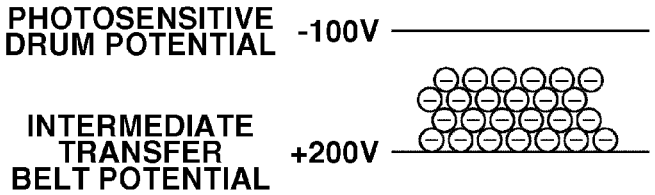

FIG. 7C illustrates a state where multiplexed transfer is completed.

Primary transfer of toner depends on the toner charge amount and a potential difference between the potential of the photosensitive drum and the potential of the intermediate transfer belt 8. This means that a certain fixed potential of the intermediate transfer belt 8 is necessary to ensure the primary transfer performance.

Under the above-mentioned conditions of the present exemplary embodiment, the potential of the intermediate transfer belt 8 necessary to primarily transfer the developed toner image on the photosensitive drum is considered to be 200 V or higher.

Figure 7D:
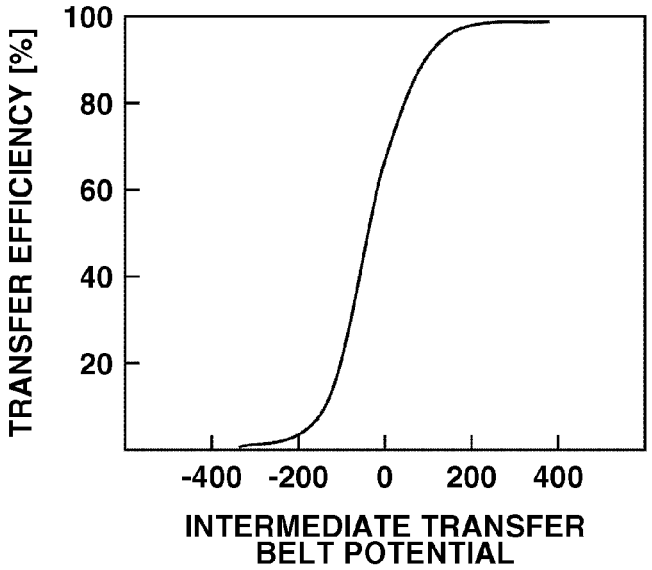

FIG. 7D is a graph illustrating a relation between the potential of the intermediate transfer belt 8 assigned to the horizontal axis and a transfer efficiency assigned to the vertical axis. The transfer efficiency is an index of transfer performance which indicates what percentage of the developed toner image on the photosensitive drum has been transferred onto the intermediate transfer belt 8. Generally, when the transfer efficiency is 95% or higher, toner is determined to have normally been transferred. FIG. 7D illustrates that 98% or above of toner has been transferred well by a potential of the intermediate transfer belt 8 of 200 V or higher.

In this case, all of the image forming units 1*a*, 1*b* 1*c*, and 1*d* have the same potential difference between each photosensitive drum and the intermediate transfer belt 8. More specifically, at all of the primary transfer sections for the image forming units 1*a*, 1*b*, 1*c*, and 1*d*, a potential difference of 300 V is formed between a potential of each photosensitive drum of −100 V and a potential of the intermediate transfer belt 8 of +200 V. This potential difference is required for multiplexed transfer for the above-mentioned three different toner colors (300% toner amount assuming the amount for monochrome solid as 100%), and is almost equivalent to that formed when a primary transfer bias is applied to respective primary transfer rollers with the conventional primary transfer configuration. An ordinary image forming apparatus does not perform image forming with 400% toner amount even if it is provided with toner of four colors. Instead, the image forming apparatus is capable of sufficient full color image formation with a maximum toner amount of about 210% to 280%.

The present exemplary embodiment, therefore, enables primary transfer by passing a current in the circumferential direction of the intermediate transfer belt 8 so that a predetermined surface potential of the intermediate transfer belt 8 is obtained. In other words, the transfer power supply 33 passes a current from the primary transfer power feeding roller 31 contacting the outer surface of the intermediate transfer belt 8 to the photosensitive drums 2*a*, 2*b*, 2*c*, and 2*d* via the intermediate transfer belt 8 to achieve primary transfer. In the present exemplary embodiment, a voltage is applied to the primary transfer power feeding roller 31 to enable primary transfer with one transfer power supply.

Since the primary transfer power feeding roller 31 is arranged on the downstream side of the belt cleaning unit 75 in the rotational direction of the intermediate transfer belt 8, residual toner or other sticking substances do not easily adhere to the primary transfer power feeding roller 31. This means that a current can be stably supplied to the surface of the intermediate transfer belt 8 since the surface is constantly cleaned by the belt cleaning unit 75 not to be subjected to toner or other sticking substances, thus achieving stable current supply.

Figure 8A:
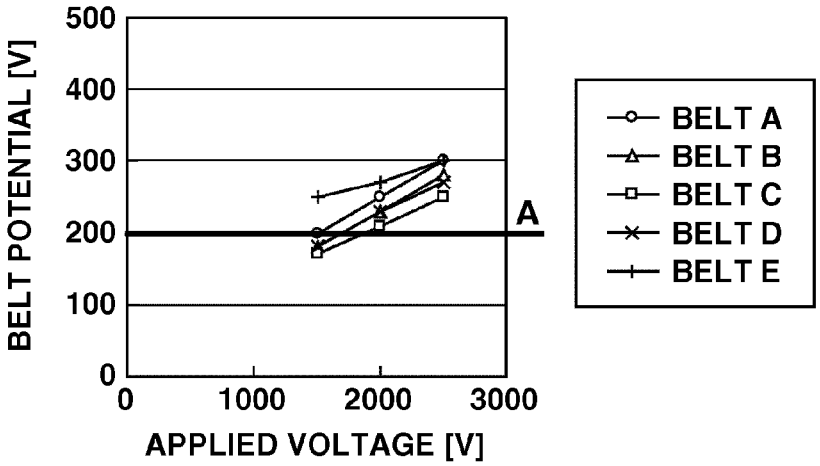
FIGS. 8A to 8C are graphs illustrating a relation between a potential measurement result for the intermediate transfer belt and a primary transfer feasible region.
Figure 8B:
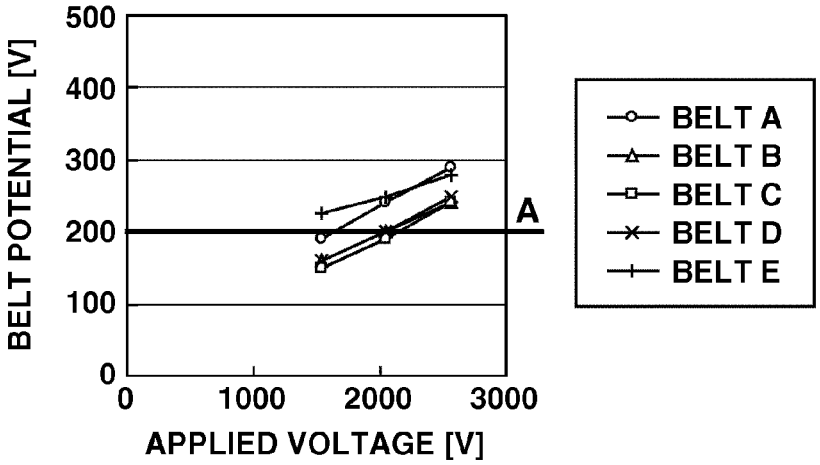
Figure 8C:
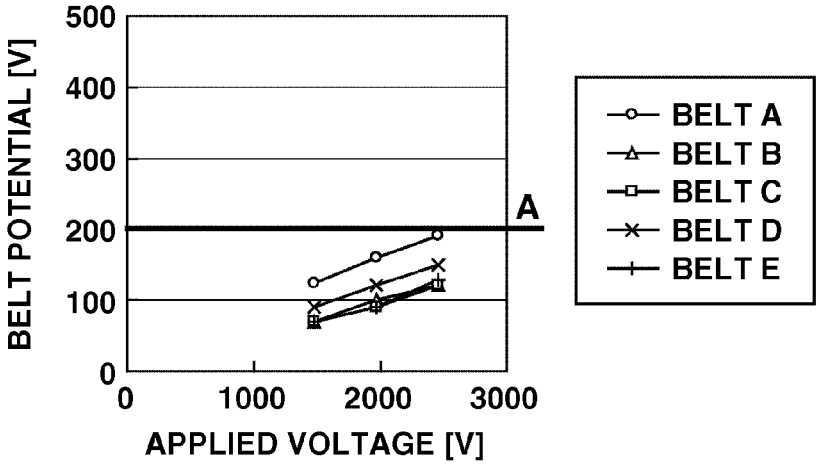

FIGS. 8A to 8C illustrate measurement results obtained when primary transfer achieving conditions are taken into account for the potential of the intermediate transfer belt 8 in FIGS. 6A to 6C. Referring to FIGS. 8A to 8C, a heavy line A indicates the potential of the intermediate transfer belt 8 necessary to perform primary transfer. In the case of 1 GΩ and 100 MΩ resistances (FIGS. 8A and 8B, respectively), applying an applied voltage having a predetermined value or higher to the intermediate transfer belt 8 produces a surface potential of the intermediate transfer belt 8 having a predetermined voltage (200 V in the present exemplary embodiment) or higher, achieving preferable primary transfer. In the case of 10 MΩ resistance (FIG. 8C), an applied voltage higher than 3000 V needs to be applied. Even in the case of 10 MΩ resistance, although increasing the transfer voltage achieves good primary transfer, the capacity of the transfer power supply 19 needs to be actually increased to pass a current to the supporting rollers 11, 12, and 13. In this case, a primary transfer current output from the transfer voltage power supply is 20 μA. Even when the transfer voltage is 2 kV, a voltage of about 500 V or below is actually applied to the intermediate transfer belt 8 because of the resistance of an elastic layer of the primary transfer power feeding roller 31. In this case, as illustrated in FIG. 3B, when a voltage of several hundreds volts is applied to the intermediate transfer belt 8, a sufficient current flows in the circumferential direction of the intermediate transfer belt 8.

When an applied voltage of several hundreds volts is applied to the primary transfer power feeding roller 31 and a transfer current is several tens microamperes, the primary transfer achieving conditions are met with a belt circumferential resistance of $10^4$ to $10^8$Ω.

Figure 9:
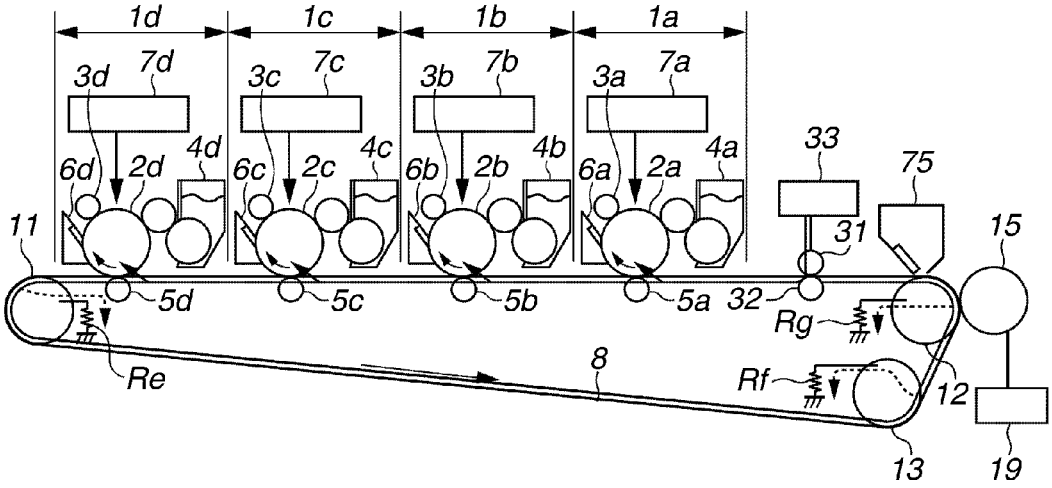
[FIG. 9]

FIG. 9 schematically illustrates a current flowing from the primary transfer power feeding roller 31 to the intermediate transfer belt 8. Referring to FIG. 9, the resistors Re, Rg, and Rf are connected to the supporting rollers 11, 12, and 13, respectively. Arrows with a thick solid line indicate currents flowing from the primary transfer power feeding roller 31 to the photosensitive drums 2*a*, 2*b*, 2*c*, and 2*d*. Arrows with a thick dashed line indicate currents flowing into the supporting rollers 11, 12, and 13. As mentioned above, these currents increase with decreasing resistance values Re, Rg, and Rf. Since the image forming units 1*a*, 1*b* 1*c*, and 1*d* have almost the same potential difference between respective photosensitive drum and the intermediate transfer belt 8, almost the same current flows into the photosensitive drums 2*a*, 2*b*, 2*c*, and 2*d*. However, variation in thickness of the photosensitive layer on the photosensitive drums 2*a*, 2*b*, 2*c*, and 2*d* of the image forming units 1*a*, 1*b*, 1*c*, and 1*d* causes variation in capacitance, possibly causing variation in current flowing into respective photosensitive drums. In the present exemplary embodiment, the thickness of the photosensitive layer is 10 μm to 20 μm after the sheet-passing duration.

Secondary transfer is achieved by applying the secondary transfer voltage to the secondary transfer roller 15 from a voltage power supply 19 for secondary transfer. According to conditions of the present exemplary embodiment, quality paper (with a grammage of 75 g/m$^2$) is used as a transfer material, and the secondary transfer voltage required for secondary transfer is 2 kV or above.

Timings of primary and secondary transfer will be described below. With the image forming apparatus according to the present exemplary embodiment, the primary transfer sections and the secondary transfer section occupy a semicircle of the intermediate transfer belt 8, as illustrated in FIG. 1. In other words, an image for one sheet is formed over the semicircle range. The transfer power supply 33 for primary transfer starts voltage application to the primary transfer power feeding roller 31 at the start timing of primary transfer and stops voltage application upon completion of primary transfer. When a primarily transferred toner image on the intermediate transfer belt 8 arrives at the secondary transfer section, the voltage power supply 19 applies the secondary transfer voltage to the secondary transfer roller 15 in synchronization with a timing at which a transfer material supplied from a registration roller (not illustrated) reaches the secondary transfer section. Upon completion of secondary transfer, the voltage power supply 19 stops voltage application.

In the case of continuous printing, charge and development timings are adjusted to enable performing primary transfer after completion of secondary transfer for previous image formation, preventing primary and secondary transfer from being performed at the same timing. Specifically, the current supplied from the primary transfer power feeding roller 31 to the intermediate transfer belt 8 can be prevented from flowing in the circumferential direction of the intermediate transfer belt 8 into the secondary transfer section.

Figure 10:
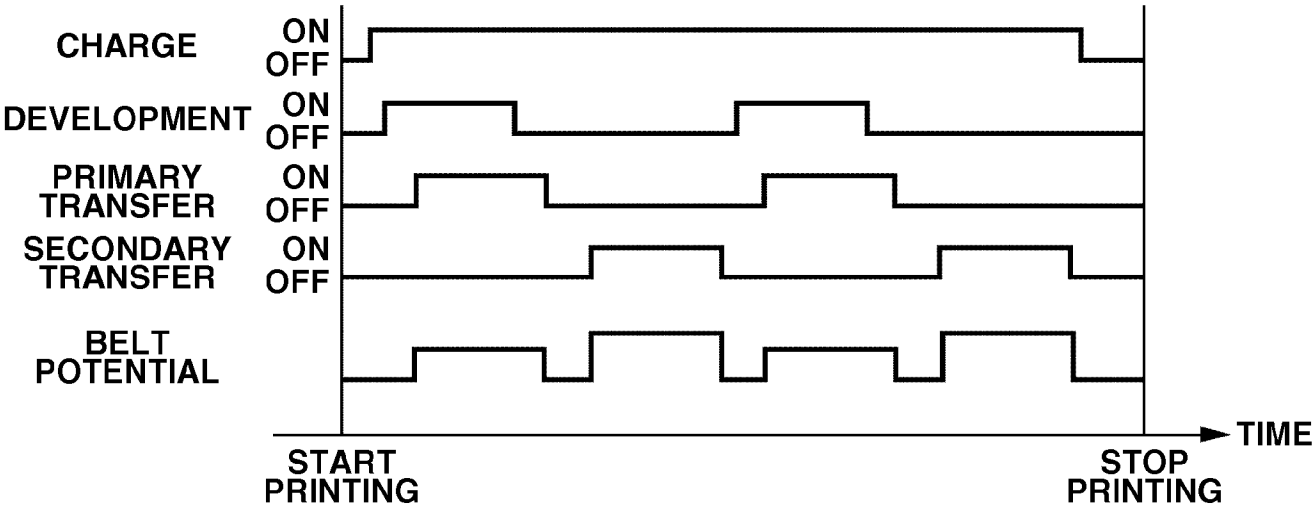
[FIG. 10]

FIG. 10 illustrates voltage application timings in exemplary continuous printing on two sheets. For charge, development, and primary transfer, voltage application timings are illustrated collectively for four colors (from the start of yellow to the end of black). When printing is started, the charge voltage is turned ON. Then, after image exposure for the first sheet, the development voltage is turned ON and then the primary transfer voltage is turned ON (to perform primary transfer). After completion of primary transfer for the first sheet, the secondary transfer voltage is turned ON (to perform secondary transfer). After completion of secondary transfer for the first sheet, development, primary transfer, and secondary transfer are performed in succession. After completion of fixing, printing ends.

In the present exemplary embodiment, referring to FIG. 10, the potential of the intermediate transfer belt 8 during a period of secondary transfer ON is slightly higher than that during a period of primary transfer ON. If the transfer power supply 33 and the secondary transfer power supply 19 apply voltages at the same timing, the above-mentioned potential of the intermediate transfer belt 8 fluctuates possibly causing unstable primary or secondary transfer performance. The present exemplary embodiment makes it possible to apply a voltage most suitable for primary transfer to the primary transfer sections from the transfer power supply 33 at the time of primary transfer, and a voltage most suitable for secondary transfer to the secondary transfer section from the secondary transfer power supply 19 at the time of secondary transfer.

Figure 11A:
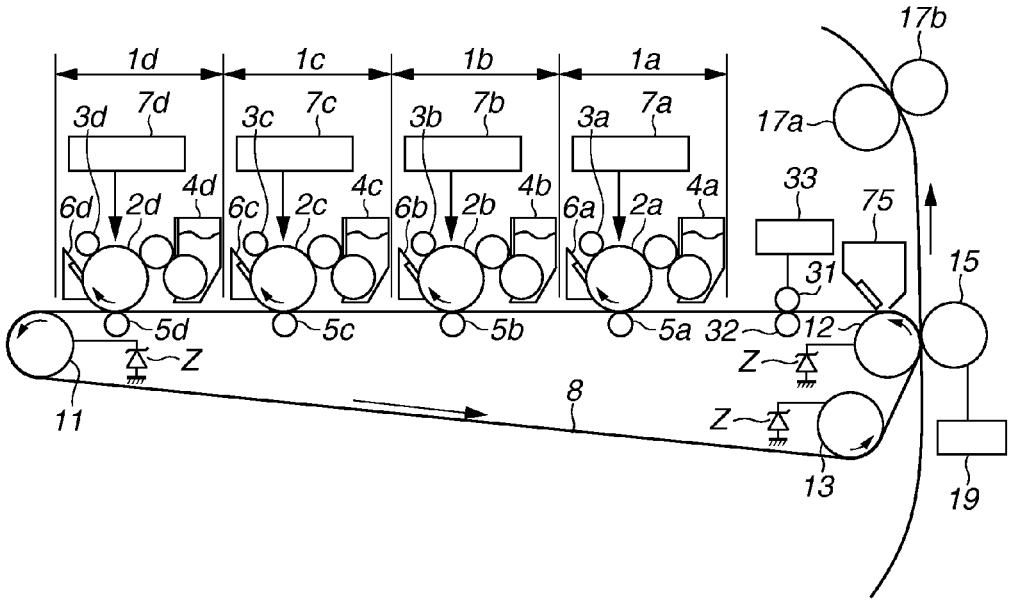
FIGS. 11A and 11B are sectional views schematically illustrating a state where a Zener diode or varistor is connected to each supporting member.
Figure 11B:
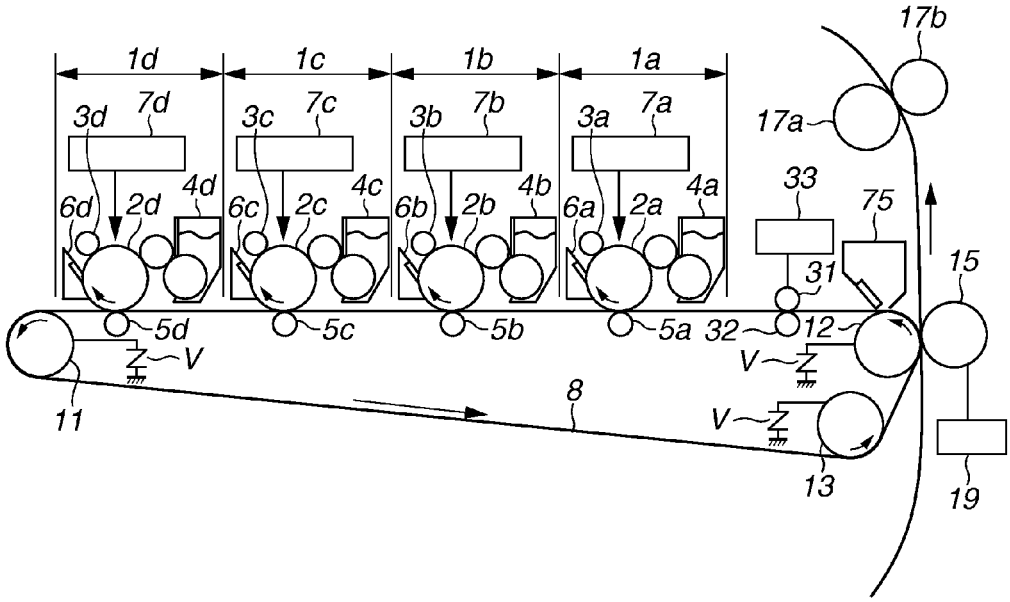

As illustrated in FIGS. 11A and 11B, a constant voltage element may be connected to each of the supporting rollers 11, 12, and 13; and the transfer power supply 33 and the secondary transfer power supply 19 may output voltages at the same time to simultaneously perform primary and secondary transfer. FIG. 11A illustrates a state where a Zener diode is connected to each of the supporting members 11, 12, and 13 as a constant voltage element. FIG. 11B illustrates a state where a varistor is connected to each of the supporting members 11, 12, and 13 as a constant voltage element.

In the case of Zener diodes or varistors, however, when the potential of the intermediate transfer belt 8 exceeds the Zener diode potential or varistor potential, a current flows maintaining the Zener diode potential or varistor potential. Therefore, even if the transfer power supply 33 and the secondary transfer power supply 19 output voltages at the same time, the potential of the intermediate transfer belt 8 does not reach or exceed the Zener diode potential or varistor potential. The potential of the intermediate transfer belt 8 can be maintained constant in this way, maintaining the primary transfer performance more stably. Therefore, connecting a constant voltage element to each of the supporting rollers 11, 12, and 13 enables simultaneously performing primary and secondary transfer. In the present exemplary embodiment, the Zener diode potential or varistor potential is set to 220 V in consideration of environmental effects.

Figure 12A:
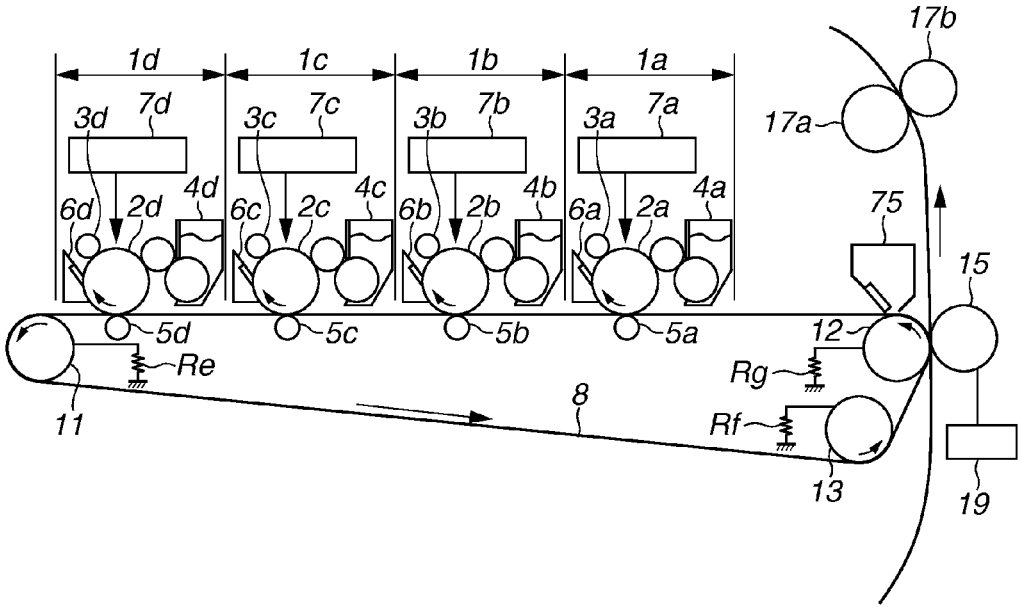
FIGS. 12A to 12C are sectional views schematically illustrating a state where a secondary transfer roller is used as a current supply member.
Figure 12B:
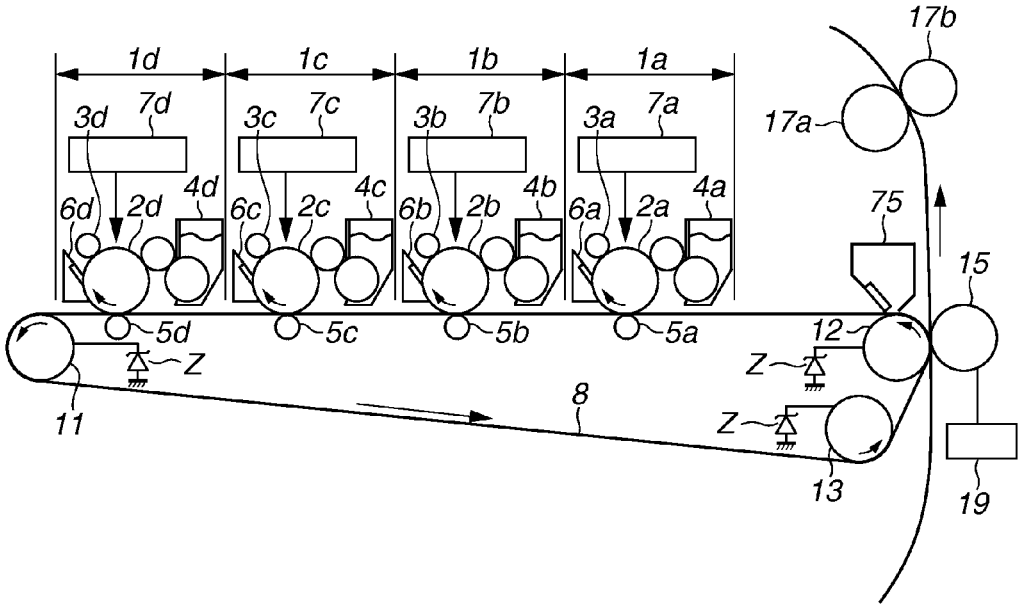
Figure 12C:
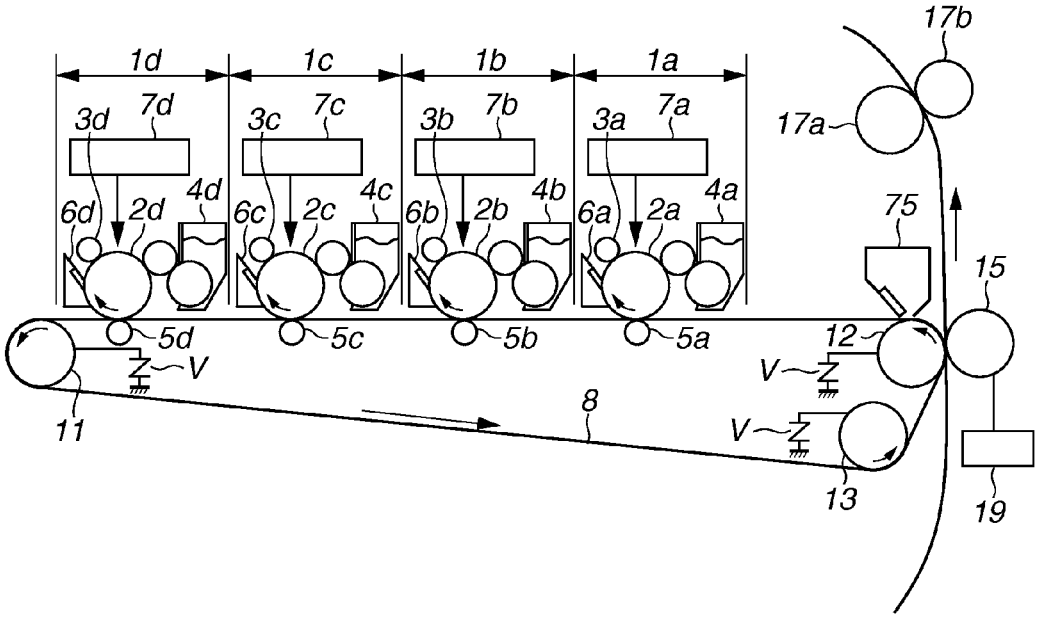

As illustrated in FIG. 12A, the secondary transfer power supply 19 may supply a current to the primary transfer sections. In this case, the secondary transfer roller 15 serves as a current supply member which contacts the outer surface of the intermediate transfer belt 8. This configuration enables supplying voltages for performing primary and secondary transfer by using one power supply. Even in this case, a constant voltage element may be connected to each of the supporting rollers 11, 12, and 13, as illustrated in FIGS. 12B and 12C. Connecting a constant voltage element to each of the supporting rollers 11, 12, and 13 enables maintaining the surface potential of the intermediate transfer belt 8 to a predetermined potential, achieving stable primary transfer performance.

According to the configuration of the present exemplary embodiment, primary transfer is achieved in this way by using a conductive intermediate transfer belt and sending via the intermediate transfer belt a transfer current to the photosensitive drums 2*a*, 2*b*, 2*c*, and 2*d* from the current supply member 15 contacting the outer surface of the intermediate transfer belt 8. This configuration can reduce the number of voltage power supplies for primary transfer, thus reducing cost and size of the image forming apparatus.

In the present exemplary embodiment, a current supply member (the primary transfer power feeding roller 31 or the secondary transfer roller 15) is arranged on the outer circumferential surface of the intermediate transfer belt 8. Generally, the intermediate transfer belt 8; the three supporting rollers (supporting members) including the drive roller 11, the secondary transfer counter roller 12, and the tension roller 13; and the counter members 5*a*, 5*b*, 5*c*, and 5*d* are integrated into a replaceable intermediate transfer unit for the image forming apparatus. The above-mentioned replaceable unit configuration is employed since the durable term of, for example, the intermediate transfer belt 8 and the counter members 5*a*, 5*b*, 5*c*, and 5*d* is shorter than that of the image forming apparatus, and is intended for such a case where a user accidentally damages the intermediate transfer belt 8. However, to reduce the running cost of printing, it is necessary to reduce the frequency of replacement of the intermediate transfer unit to extend its operating life.

For the above-mentioned reason, the transfer power supply for primary transfer and the current supply member are arranged outside the intermediate transfer belt 8, i.e., on the side of the image forming apparatus to make it easier to replace the intermediate transfer unit.

The voltage supplied to the current supply member may be based on constant voltage control, constant current control, or a combination of both as long as the image forming apparatus can exhibit its full primary transfer performance.

Although, in the present exemplary embodiment, the intermediate transfer belt 8 is made of PPS containing additive carbon to provide electrical conductivity, the composition of the intermediate transfer belt 8 is not limited thereto. Even with other resins and metals, similar effects to those of the present exemplary embodiment can be expected as long as equivalent electrical conductivity is achieved. Although, in the present exemplary embodiment, single-layer and two-layer intermediate transfer belts are used, the layer configuration of the intermediate transfer belt 8 is not limited thereto. Even with a three-layer intermediate transfer belt including, for example, an elastic layer, similar effects to those of the present exemplary embodiment can be expected as long as the above-mentioned circumferential resistance is achieved.

Although, in the present exemplary embodiment, the intermediate transfer belt 8 having two layers is manufactured by forming a base layer first and then a coating layer thereon, the manufacture method is not limited thereto. For example, casting may be used as long as relevant resistance values satisfy the above-mentioned conditions.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Applications No. 2010-225220 filed Oct. 4, 2010 and No. 2011-212310 filed Sep. 28, 2011, which are hereby incorporated by reference herein in their entirety.

The invention claimed is:

1. An image forming apparatus comprising:

a plurality of image bearing members configured to bear toner images;

a rotatable endless intermediate transfer belt configured to secondarily transfer onto a transfer material the toner images primarily transferred from the plurality of image bearing members;

a current supply member contacting an outer surface of an outer side of the intermediate transfer belt, configured to supply a current to the intermediate transfer belt;

a power supply configured to apply a voltage to the current supply member, wherein, by being applied with a voltage from the power supply, the current supply member performs a primary transfer of a toner image from the plurality of image bearing members to the intermediate transfer belt by following a current in circumferential direction with respect to the intermediate transfer belt.

2. The image forming apparatus according to claim 1, further comprising:

a cleaning unit configured to collect toner adhering to the intermediate transfer belt, wherein the current supply member contacts the intermediate transfer belt at a position on a downstream side of the cleaning unit and on an upstream side of the plurality of image bearing members in the rotational direction of the intermediate transfer belt.

3. The image forming apparatus according to claim 1, further comprising:

a secondary transfer member configured to contact an outer circumferential surface of the intermediate transfer belt to form a secondary transfer section with the intermediate transfer belt, and a secondary transfer power supply configured to apply a voltage to the secondary transfer member.

4. The image forming apparatus according to claim 3, wherein the power supply stops voltage application to the current supply member at a timing at which primary transfer of the toner images from the plurality of image bearing members onto the intermediate transfer belt is completed, and wherein the second transfer power supply starts voltage application to the secondary transfer member after the timing at which primary transfer is completed.

5. The image forming apparatus according to claim 3, further comprising:

a supporting member configured to support the intermediate transfer belt, wherein a constant voltage element for maintaining a surface potential of the intermediate transfer belt to a predetermined potential or higher is connected to the supporting member.

6. The image forming apparatus according to claim 5, wherein the constant voltage element is a Zener diode or a varistor.

7. The image forming apparatus according to claim 5, wherein the power supply applies a voltage to the current supply member to primarily transfer the toner images from the image bearing members to the intermediate transfer belt and, at the same time, the secondary transfer power supply applies a voltage to the secondary transfer member to secondarily transfer the toner images from the intermediate transfer belt to the transfer material.

8. The image forming apparatus according to claim 1, wherein a first metal roller to which a measurement voltage is applied by a measurement power supply contacts the intermediate transfer belt, wherein a second metal roller to which a current detection unit is connected contacts the intermediate transfer belt at a position separated from the first metal roller in the rotational direction of the intermediate transfer belt, wherein a value obtained by dividing the measurement voltage by a current value detected by the current detection unit is defined as a circumferential resistance of the intermediate transfer belt, and wherein the value of the circumferential resistance of the intermediate transfer belt is $10^4\Omega$ or above and $10^8\Omega$ or below.

9. The image forming apparatus according to claim 1, further comprising:

a plurality of counter members at respective positions facing the plurality of image bearing members via the intermediate transfer belt, wherein the intermediate transfer belt contacts the plurality of image bearing members via the plurality of counter members.

10. The image forming apparatus according to claim 9, wherein the plurality of counter members is electrically insulated.

11. The image forming apparatus according to claim 1, wherein the power supply sends a current from the current supply member to the plurality of image bearing members via the intermediate transfer belt to maintain a surface potential of the intermediate transfer belt to an equal potential at respective primary transfer sections at which the toner images are transferred from the plurality of image bearing members onto the intermediate transfer belt.

* * * * *